US008065776B2

(12) United States Patent
Tuomivirta et al.

(10) Patent No.: US 8,065,776 B2
(45) Date of Patent: Nov. 29, 2011

(54) CLEANING IMPLEMENT AND A MOP DESIGNED THEREFOR

(75) Inventors: Reima Tuomivirta, Helsinki (FI); Janne Tuomivirta, Kerava (FI)

(73) Assignee: Primapalvelu-JT Oy, Kerava (FI)

( * ) Notice: Subject to any disclaimer, the term of this patent is extended or adjusted under 35 U.S.C. 154(b) by 536 days.

(21) Appl. No.: 12/162,363

(22) PCT Filed: Jan. 25, 2007

(86) PCT No.: PCT/FI2007/000022
§ 371 (c)(1),
(2), (4) Date: Oct. 22, 2008

(87) PCT Pub. No.: WO2007/085686
PCT Pub. Date: Aug. 2, 2007

(65) Prior Publication Data

US 2009/0300866 A1 Dec. 10, 2009

(30) Foreign Application Priority Data

Jan. 26, 2006 (FI) ..... 20060076

(51) Int. Cl.
*A47L 13/20* (2006.01)
*A47L 13/254* (2006.01)
*A47L 13/255* (2006.01)

(52) U.S. Cl. ..... 15/229.8; 15/147.2; 15/228; 15/229.1; 15/229.6

(58) Field of Classification Search ..... 15/208, 15/209.1, 210.1, 220.1, 220.2, 147.1, 147.2, 15/228, 229.1–229.4, 229.6–229.8, 231, 15/232
See application file for complete search history.

(56) References Cited

U.S. PATENT DOCUMENTS

| | | | | |
|---|---|---|---|---|
| 4,603,450 | A | 8/1986 | Osberghaus et al. | |
| 4,658,461 | A | 4/1987 | Moore et al. | |
| 4,885,195 | A * | 12/1989 | Change, III | 428/36.1 |
| 5,253,387 | A | 10/1993 | Kresse et al. | |
| 2007/0074365 | A1 * | 4/2007 | Erdman et al. | 15/228 |

FOREIGN PATENT DOCUMENTS

| | | | |
|---|---|---|---|
| DE | 295 01 258.7 | U1 | 4/1995 |
| DE | 197 03 867 | A1 | 8/1998 |
| DE | 199 40 436 | A1 | 3/2001 |
| EP | 0 150 417 | B1 | 7/1987 |

(Continued)

*Primary Examiner* — Mark Spisich
(74) *Attorney, Agent, or Firm* — Young & Thompson

(57) ABSTRACT

A cleaning implement comprises a handle (1), a plate frame (2) connected to the handle, and a mop (3) that is detachably attached to the plate frame. At least one pair of holding members, consisting of a permanent magnet and a counterpart cooperating therewith, has been arranged for holding of the mop (3) onto the plate frame (2). The magnet and the counterpart have been attached to the plate frame (2) and to the mop (3), respectively, so that they face each other in the operating position of the mop. The counterpart may consist of a permanent magnet or a ferromagnetic substance and it has been anchored, for example, by sewing inside the mop (3) under a fabric that forms the upper surface of the mop. The specification also relates to the mop (3) per se, which is provided with at least one magnetic holding member arranged in the vicinity of the upper surface of the mop and, in the operating position of the mop, cooperating with the magnetic fastening part which is in a corresponding position on the plate frame.

6 Claims, 1 Drawing Sheet

FOREIGN PATENT DOCUMENTS

| | | | |
|---|---|---|---|
| FI | 93515 | B | 4/1992 |
| GB | 2 329 282 | A | 3/1999 |
| SE | 500 842 | C2 | 9/1994 |
| WO | 94/23635 | A1 | 10/1994 |
| WO | 99/05956 | A1 | 2/1999 |
| WO | 2004/086931 | A1 | 10/2004 |

* cited by examiner

CLEANING IMPLEMENT AND A MOP DESIGNED THEREFOR

The present invention relates to a cleaning implement comprising a handle, a plate frame connected to the handle, and a mop detachably attached to the plate frame, at least one pair of holding members, consisting of a permanent magnet and a cooperating counterpart, being arranged for holding the mop onto the plate frame, whereby the magnet and the counterpart are essentially planar at the surfaces that come towards each other and they are attached to the plate frame and to the mop, respectively, so that they face each other in the operating position of the mop.

The invention also relates to the mop belonging to said cleaning implement.

BACKGROUND OF THE INVENTION

Various solutions have been developed to attach mops to cleaning implements. Of course, the basic intention is that the attachment be relatively firm and quick, and possible to carry out without touching by hand. This requirement is important at least in professional use.

A fairly common solution is the one comprising a pocket or a loop at one end of the mop receiving one end of the plate frame of the cleaning implement, the plate frame being pushed into the pocket by sliding it from the side, whereby the mop can be kept in place, for example, by pushing it against the floor by foot. In the known solutions, the other end of the mop is held, e.g., by means of a piece of Velcro, a flexible loop or a tongue provided with a press fastener.

The Velcro fastening, of course, has the disadvantage that its holding power weakens depending on the instances of use, i.e., it works fairly well in household use but not so well in professional use. In repeated use, the above-mentioned flexible loop or the tongue provided with a press fastener may be a more durable solution, but their weaknesses: slowness to some extent and, perhaps, also the fact that they are difficult to attach without touching by hand.

Attachment solutions as mentioned in the preamble, which are based on a magnetizing force, are disclosed in publications U.S. Pat. No. 4,658,461 and DE 19940436, for example.

In said US publication, a magnetic rod is provided at the upper part of the cleaning implement, cooperating with a metal plate that constitutes the upper surface of the mop. In the DE publication, in turn, the upper surface of the mop is provided with a mop. In the DE publication, in turn, the upper surface of the mop is provided with a raster that is made of a mixture of metal powder attached to the surface of the mop by a suitable means, such as gluing or spraying.

The problem with these known solutions is that it is inconvenient to squeeze water out of the mop during working, and it is virtually impossible to clean the mop in a washing machine, for example.

Therefore, the purpose of the present invention is to provide a mop attachment that utilizes the magnetizing force and both allows removal of water from the mop and washing of the mop by conventional means.

SUMMARY OF THE INVENTION

To achieve this the cleaning implement according to the invention is characterized in that which is presented in the appended Claim 1.

The characteristic features of the mop itself are disclosed in Claim 6, correspondingly.

The said counterpart can be a permanent magnet or a ferromagnetic block of metal. Of course, at least one of the components of the pair of holding members should consist of a permanent magnet, and the best aggregation force is attained by means of a pair of holding members formed by two permanent magnets.

According to a preferred embodiment of the invention, the mop attachment at one end of the combination of the plate frame and the mop is further carried out by pushing the end of the plate frame into the pocket of the mop, whereby the magnetic attachment is located at the opposite end of the combination. This way of fastening is especially preferable for a pair of magnets as compared with the Velcro attachment, for example, as when placed against each other, the magnets by nature pull the plate frame in its final place. Correspondingly, the detachment of the magnets is best carried out by pulling them sideways, i.e., while sliding the plate frame out of the pocket.

The planar magnetic piece is anchored, for example, by sewing it inside the mop. In practice, it has been observed that even though the fabric of the upper surface of the mop is generally quite heavy and rough and, thus, not very thin, the attractive force of the pair of magnets is quite sufficient to keep the mop in place.

BRIEF DESCRIPTION OF THE DRAWINGS

In the following, the invention and its further characteristics and advantages are described with the aid of an example and with reference to the appended drawings, in which.

DETAILED DESCRIPTION OF THE PREFERRED EMBODIMENTS

Figure 1:
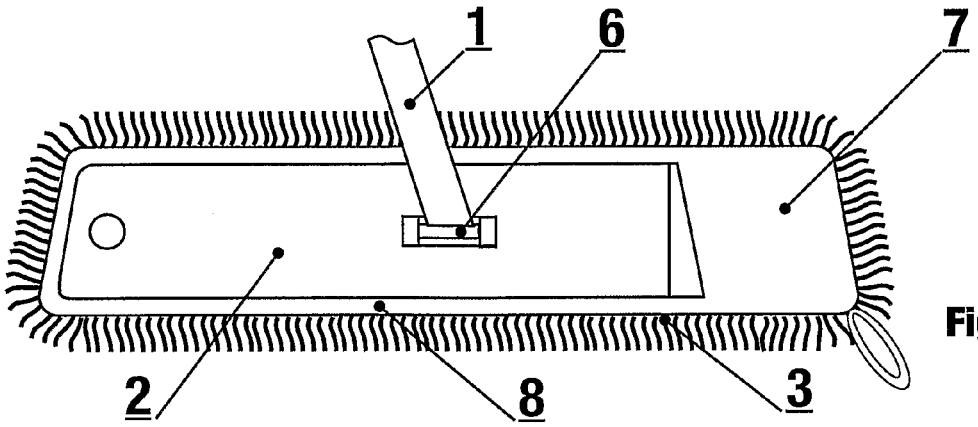
FIG. 1 shows the cleaning implement according to the invention from above.

The cleaning implement according to FIG. 1 includes a handle 1, connected through a universal joint 6 to the plate frame 2. In a well-known manner, the plate frame is essentially keystone shaped, as viewed from above.

A mop 3 made of a heavy fabric is placed under the plate frame 2, the lower surface of the mop being fluffy in a known manner. To attach the mop to the plate frame, a pocket 7 is provided at the one end of the mop, one end of the plate frame being pushed into the pocket.

Figure 3:
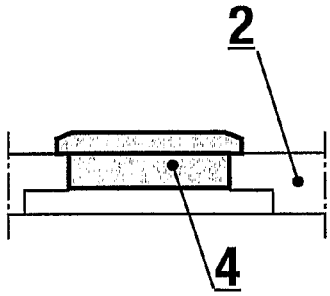
FIG. 3 shows a section of the plate frame from the side on an enlarged scale.
Figure 4:
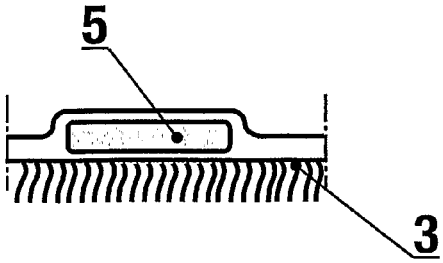
FIG. 4 shows a section of the mop according to the invention from the side and also on an enlarged scale.

According to the invention, the end of the mop opposite to the pocket 7 is attached to the plate frame by means of a magnetic attachment, as described below with reference to FIGS. 2-4.

A permanent magnet 4 is embedded into the lower surface of the plate frame 2, the magnet being in the form of a flat button in the Figure. The embedding is carried out so that the lower surface of the round magnet remains slightly higher than the lower surface of the plate frame 2, while the lower surface of the plate frame is provided with a cavity that is slightly larger than a counterpart 5. The magnet 4 is attached to the plate frame by glue or mechanically.

In a corresponding place in the mop 3, the counterpart 5 of the magnet 4 has been sewn inside the mop, the counterpart being metallic or, alternatively, preferably a permanent magnet similar to the magnetic button of the plate frame. Naturally, the magnets are arranged so that the surfaces facing each other have opposite polarities.

The counterpart 5 is suitably anchored in place under the fabric of the upper surface of the mop by sewing. Around the metal or the magnet, a separate fabric or plastic can be provided, as shown in FIG. 4. The stitches are not shown in the figure.

Of course, the counterpart 5 can also be attached so that a separate piece of fabric covers the metal or the magnet, i.e., forms the upper surface of the mop at the position of the magnet.

The counterpart preferably produces a small protrusion at the upper surface of the mop, which protrusion is received in the above-mentioned cavity in the plate frame, this improving the grip of the magnetic attachment in the lateral direction.

Figure 2:
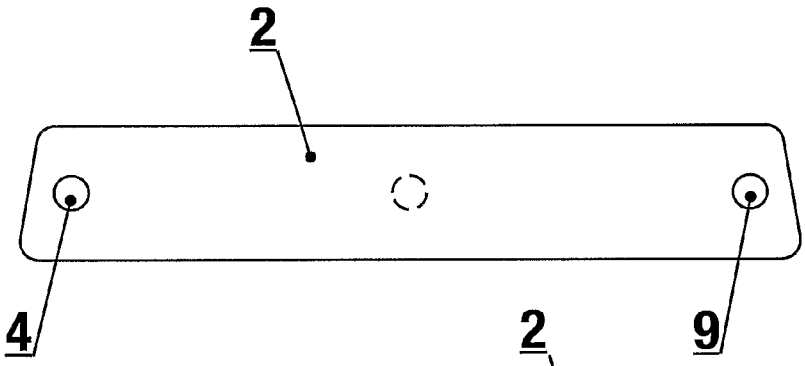
FIG. 2 shows the plate frame of the cleaning implement from below.

It is obvious that more than one pair of magnetic holding members can also be used, as outlined in FIG. 2, i.e., the plate frame can also include a magnet 9 in the middle or at one end thereof.

One advantage of the magnetic attachment is that the magnets, or the magnet and its counterpart pull the mop into place near the final position of the mop. The detachment also takes place rather sideways than by pulling directly upwards. To prevent the unfastening of the attachment, when using the mop in a lateral swipe, it may be preferable to arrange quite a short counter pocket or other supporting edge 8 at the end opposite to the actual fastening pocket 7, as shown in FIG. 1.

In practice, it has been observed that, normally, one pair of magnetic holding members is sufficient and, as already stated earlier, both members 4 and 5 are preferably permanent magnets.

The magnet and the counterpart are, of course, preferably coated to prevent corrosion. At least the magnetic member in the mop can have, for example, a round shape, a diameter of less than 5 cm, and a thickness of 3-8 mm. When placed inside the mop, such a piece of magnet neither prevents the squeezing of water from the mop nor the machine washing of the mop.

The invention claimed is:

1. A cleaning implement comprising:

a handle, (1);

a plate frame (2) connected to the handle and including a magnet (4); and a mop (3) detachably attached to the plate frame, including a cooperating counterpart (5), the magnet (4) and the counterpart (5) constituting a pair of holding members configured for detachably holding the mop (3) onto the plate frame (2), the magnet (4) and the counterpart (5) each being essentially planar at respective surfaces configured to come towards each other, and the magnet (4) and the counterpart (5) being attached to the plate frame (2) and to the mop (3), respectively, so that the magnet (4) and the counterpart (5) face each other in an operating position of the mop, wherein the counterpart (5) is sewn inside a fabric that constitutes an upper surface of the mop to form a protrusion at an upper surface of the mop, and wherein the magnet (4) is attached to the plate frame (2) so that a cavity shallow with respect to the lower surface of the plate frame remains under the magnet, said protrusion being received in the cavity when the mop is attached to the plate frame.

2. The cleaning implement according to claim 1, wherein the counterpart (5) consists of a permanent magnet or a ferromagnetic substance.

3. A cleaning implement, comprising:

a handle (1);

a plate frame (2) connected to the handle and including a magnet (4);

a mop (3) detachably attached to the plate frame, including a cooperating counterpart (5) at a first end of an upper surface of the mop and located under a fabric that constitutes the upper surface, the magnet (4) and the counterpart (5) constituting a pair of holding members configured for detachably holding the mop (3) onto the plate frame (2), the magnet (4) and the counterpart (5) each having essentially planar surfaces configured to correspond with each other, and the magnet (4) and the counterpart (5) being attached to the plate frame (2) and to the mop (3), respectively, so that the magnet (4) and the counterpart (5) face each other when in an operating position of the mop, the mop (3) also including any of a loop or a pocket (7), for receiving an end of the plate frame (2), located at a second end of the upper surface of the mop opposite the first end of the upper surface of the mop.

4. A mop (3) of a cleaning implement, intended to be detachably attached under a plate frame (2) provided with a handle (1), the mop comprising:

an upper surface;

at least one flat-shaped first magnetic holding member (5) arranged in the vicinity of the upper surface, the first magnetic holding member configured to cooperate, in an operating configuration in attachment with the plate frame (2), with a second magnetic holding member (4) in a corresponding position on the plate frame, the mop further comprising any of a loop or pocket (7) for receiving and end of the plate frame (2), located at one end of the upper surface, the first magnetic holding member (5) being located at an opposite end of the upper surface, wherein the first magnetic holding member (5) is sewn inside the mop (3) under a fabric that forms the upper surface of the mop so that the first magnetic holding member (5) produces a protrusion at the upper surface of the mop, the protrusion configured to cooperate with a cavity in a lower surface of the plate frame when the mop is in the operating configuration.

5. The mop according to claim 4, wherein the first magnetic holding member (5) is a permanent magnet.

6. The mop according to claim 4, wherein the first magnetic holding member (5) is a magnetizable counterpart that cooperates with the second magnetic holding member (4), the second magnetic holding member being a permanent magnet or a magnetizable counterpart that cooperates with the permanent magnet.

* * * * *